US011904984B2

(12) United States Patent
Van Der Burg

(10) Patent No.: US 11,904,984 B2
(45) Date of Patent: Feb. 20, 2024

(54) SHIP MOORING SYSTEM AND METHOD

(71) Applicant: ShoreTension Holding B.V., Rotterdam (NL)

(72) Inventor: Gerrit Van Der Burg, Barendrecht (NL)

(73) Assignee: ShoreTension Holding B.V., Rotterdam (NL)

( * ) Notice: Subject to any disclaimer, the term of this patent is extended or adjusted under 35 U.S.C. 154(b) by 331 days.

(21) Appl. No.: 17/343,090

(22) PCT Filed: Dec. 10, 2019

(86) PCT No.: PCT/NL2019/050823

§ 371 (c)(1),
(2) Date: Jun. 9, 2021

(87) PCT Pub. No.: WO2020/122716

PCT Pub. Date: Jun. 18, 2020

(65) Prior Publication Data

US 2022/0097802 A1 Mar. 31, 2022

(30) Foreign Application Priority Data

Dec. 10, 2018 (NL) ..... 2022164

(51) Int. Cl.

| | |
|---|---|
| ***B63B 21/04*** | (2006.01) |
| ***B63B 21/20*** | (2006.01) |
| ***E02B 3/24*** | (2006.01) |

(52) U.S. Cl.

CPC ..... *B63B 21/04* (2013.01); *B63B 21/20* (2013.01); *E02B 3/24* (2013.01); *B63B 2021/203* (2013.01)

(58) Field of Classification Search

CPC ... B63B 21/04; B63B 21/20; B63B 2021/203; E02B 3/24; B66D 1/741

See application file for complete search history.

(56) References Cited

U.S. PATENT DOCUMENTS

| | | | | |
|---|---|---|---|---|
| 3,865,066 A | | 2/1975 | White et al. | |
| 3,966,170 A | * | 6/1976 | McKenna | B66D 1/741 254/321 |

(Continued)

FOREIGN PATENT DOCUMENTS

| | | |
|---|---|---|
| CN | 102438886 A | 5/2012 |
| CN | 205440763 U | 8/2016 |

(Continued)

OTHER PUBLICATIONS

International Search Report and Written Opinion—PCT/NL2019/050823—dated Jun. 4, 2020.

*Primary Examiner* — Anthony D Wiest

(74) *Attorney, Agent, or Firm* — Banner & Witcoff, Ltd.

(57) ABSTRACT

A mooring post unit is provided with a cable holding device on top of the mooring post. The cable holding device has a first pulley wheel, a second pulley wheel and a cable clamp, arranged to guide a mooring cable from a ship over the first pulley wheel to the clamp, back and forth via the second pulley wheel. A hydraulic force limiter is coupled between the second pulley wheel and the mooring post. The hydraulic force is expandable and compressible in the direction of a force exerted by the axis of the pulley wheel. The hydraulic force limiter temporarily gives way when a peak in the force exceeds a threshold. The clamp comprises a pair of drums, around which the mooring cable runs back and forth. By synchronously rotating the drums, the mooring cable may be hauled in or paid out under stress.

14 Claims, 4 Drawing Sheets

(56) References Cited

U.S. PATENT DOCUMENTS

| | | | | |
|---|---|---|---|---|
| 4,493,282 | A | 1/1985 | Ortloff | |
| 5,351,430 | A * | 10/1994 | Hystad | B66D 1/50 254/273 |
| 6,119,617 | A | 9/2000 | Oswell | |
| 9,174,705 | B2 * | 11/2015 | Eilertsen | B63B 21/16 |
| 2006/0022182 | A1 | 2/2006 | Blanc | |

FOREIGN PATENT DOCUMENTS

| | | | |
|---|---|---|---|
| GB | 2009077 | A | 6/1979 |
| RU | 2029822 | C1 | 2/1995 |
| SU | 247060 | | 6/1969 |
| WO | 2010110666 | A2 | 9/2010 |
| WO | 2018048303 | A1 | 3/2018 |

* cited by examiner

SHIP MOORING SYSTEM AND METHOD

CROSS-REFERENCE TO RELATED APPLICATIONS

This application is a U.S. National Stage application under 35 U.S.C. § 371 of International Application PCT/NL2019/050823 (published as WO 2020/122716 A1), filed Dec. 10, 2019, which claims the benefit of priority to Application NL 2022164, filed Dec. 10, 2018. Benefit of the filing date of these prior applications is hereby claimed. Each of these prior applications is hereby incorporated by reference in its entirety.

The invention relates to a mooring post for mooring ships and mooring cable clamping device, as well as to methods of mooring ships.

BACKGROUND

From WO2010/110666 it is known to use a hydraulic cable holding device that can be used to keep a ship moored along a quay. The device pays out the mooring cable when the pulling force by the ship exceeds a threshold and hauls the mooring cable back in when the force disappears. The cable holding device does not require an external power source during operation and is therefore safe against failure due to power outage.

In principle, it is possible to use such a mooring device also at mooring points located out from the shore. But at such locations little space is usually available, and it involves traveling over water to make adjustments to the cable holding device. For example, the cable holding device of WO2010/110666 requires presetting the hydraulic pressure, which may require manual intervention and use of a power source. It would be desirable to use such a mooring device on a mooring post that stands isolated in the water, but the space available on such a mooring post is minimal and access is difficult.

SUMMARY

Among others, it is an object to provide for a mooring post that provides for a controllable response to forces due to movement of a moored ship.

According to one aspect, a mooring post unit according to claim 1 is provided. Herein pulley wheels are used to guide a mooring cable over hydraulic force limiter, which starts to give way when the force on the hydraulic force limiter exceeds a threshold. This makes it possible to realize a controllable response to forces due to movement of a moored ship in the limited space afforded by a mooring post.

According to another aspect the mooring cable connects the ship to the mooring post using a clamping device that comprises a first and second rotatable friction drum located offset from each other in an offset direction transverse to first and second rotation axes of the first and second friction drum, using a mooring cable that runs back and forth between the first and second friction drum alternately in successive semi-circles around the first and second rotatable friction drum, in which method the first and second friction drum are rotated synchronously to haul in and/or pay out the mooring cable from and to the ship respectively. Such a method of clamping makes it possible to haul in and pay out the mooring cable under stress. Such a clamping device and the method of clamping and part or all of its features may also be used in other circumstances than on a mooring post, but its use on a mooring post is advantageous because it requires little space and no manual intervention to adjust the length of the part of the mooring cable that is used.

According to another aspect a mooring cable clamping device according to claim 8 is provided. By using a mooring cable that is wound back and forth around multiple friction drums with different rotation axes, the mooring cable can be hauled in or paid out under stress with little wear.

This makes it possible to use mooring cables of fiber material like dyneema, e.g. of carbon fiber.

In an embodiment, one of both of the friction drums has circular grooves for passing the mooring cable each time along half a circle. This increases the amount of force that can be handled. In an embodiment the grooves have a cross-section at least partly in the shape of a circle segment, with a circle radius that is smaller than a radius of the cross-section of the mooring cable when the mooring cable is free of stress, and at least as large as a radius of the cross-section of the mooring cable when the mooring cable is under a stress. This further increases the amount of force that can be handled. Preferably, the grooves have a roughened surface (e.g. compared to other surface parts of the friction drum or the natural roughness of the material of the friction drum) to increase the force that can be handled.

The cable clamping device preferably has a control circuit configured to activate the motor or motors to rotate the first and second friction drum synchronously in a selectable direction in response to reception of a command signal that indicates the direction. The control circuit may be a programmed computer, with a program to cause it to perform the described operations. The control circuit may comprise a communication device, e.g. a wireless communication device for receiving the commands, so that remote control is possible. In the mooring post unit the control circuit may be coupled to a sensor or sensors for detecting the state of the force limiter and to control mooring cable hauling and pay out by the clamping device dependent on the state of the force limiter or a feature of the time dependence of that state.

Thus, a mooring post unit may be provided with a cable holding device on top of the mooring post. In an embodiment, the cable holding device has a first pulley wheel, a second pulley wheel and a cable clamp, arranged to guide a mooring cable from a ship over the first pulley wheel to the clamp, back and forth via the second pulley wheel. A hydraulic force limiter is coupled between the second pulley wheel and the mooring post. The hydraulic force is expandable and compressible in the direction of a force exerted by the axis of the pulley wheel. The hydraulic force limiter temporarily gives way when a peak in the force exceeds a threshold. The clamp comprises a pair of drums, around which the mooring cable runs back and forth. By synchronously rotating the drums, the mooring cable may be hauled in or paid out under stress.

In an embodiment the mooring post unit comprises a rotatable foot, arranged to rotate around as the vertical direction of the mooring post, the first pulley wheel, the second pulley wheel, the cable clamp and the hydraulic force limiter being mounted on said foot. In this way the unit is able to handle movement of the ship around the mooring post.

In an embodiment a hydraulic compression force limiter having a proximate and distal end, proximate and distal relative to the mooring post respectively, the second pulley wheel being mounted at the distal end, the first pulley wheel and the cable clamp being mounted next to the proximate end. Thus the forces from the ship are translated into compression forces on the force limiter. This reduces the internal forces needed in the force limiter. Preferably, the direction of expansion and compression of the hydraulic force limiter is in the vertical direction of the mooring post. This facilitates its use on a mooring post.

BRIEF DESCRIPTION OF THE DRAWING

These and other objects and advantageous aspects will become apparent from a description of exemplary embodiments, with reference to the following figures.

DETAILED DESCRIPTION OF EXEMPLARY EMBODIMENTS

Figure 1:
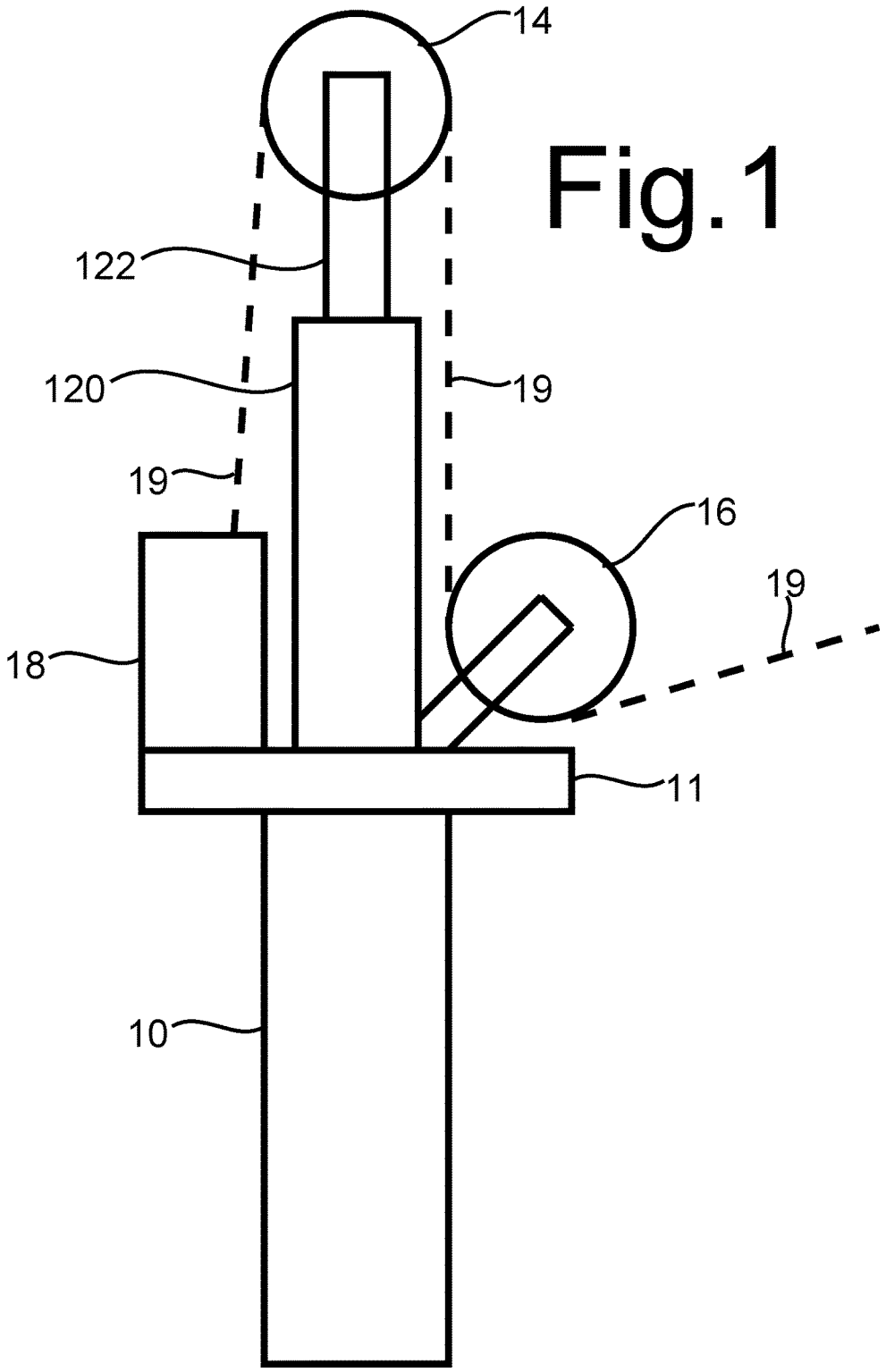
FIG. 1 shows a mooring post unit

FIG. 1 shows a mooring post unit comprising a mooring post 10 with a cable holding device on top. Mooring post 10 provides a fixed force base for transmitting forces from a mooring cable to a harbor or floor substantially without moving. Mooring post 10 may be located in the water of a harbor, founded on the harbor floor, or in open water e.g. on the sea floor. The cable holding device comprises a foot 11, a reversible hydraulic compression force limiter 120, 122, a top pulley wheel 14, a bottom pulley wheel 16 and a clamp 18. Foot 11 is mounted on top of mooring post 10, for example connected to a flange of mooring post 10. Preferably, foot 11 has a fixed part on mooring post 10 and a rotatable part on top of the fixed part, rotatable around the vertical axis. This has the advantage that it allows the cable holding device to rotate (or be rotated) to align bottom pulley wheel 16 towards the direction of the connection of the mooring cable to the ship, The reversible hydraulic compression force limiter comprises a hydraulic cylinder assembly with a hydraulic cylinder 120 and a piston rod 122. Hydraulic cylinder 120, bottom pulley wheel 16 and clamp 18 are mounted on foot 11. Bottom pulley wheel 16 and clamp 18 are located next to the bottom of hydraulic cylinder 120. Foot 11 (if applicable, the rotatable part of foot 11) comprises a first set of parallel plates that form the bearing of bottom pulley wheel 16. Preferably, as shown, bottom pulley wheel 16 and clamp 18 are located on opposite sides of hydraulic cylinder 120. Also preferably, as shown, hydraulic cylinder 120 is located above the central axis of mooring post 10.

Piston rod 122 extends into hydraulic cylinder 120 and from the top of hydraulic cylinder 120. Hydraulic cylinder assembly contains a piston (not shown) in hydraulic cylinder 120. The rotation axis of top pulley wheel 14 is mounted on the top of piston rod 122, transverse to the direction of motion of piston rod 122. The path 19 of the mooring cable is indicated schematically by a dashed line. In operation, the mooring cable is connected to a ship (not shown) and runs from the ship to bottom and around part of pulley wheel 16. From bottom pulley wheel 16, the mooring cable runs to and over part of top pulley wheel 14. From top pulley wheel 14, the mooring cable runs to clamp 18. Clamp 18 ensures that a part of the mooring cable will remain clamped in place at clamp 18 when the ship exerts a pulling force on the mooring cable.

Thus, the mooring cable exerts forces on bottom pulley wheel 16, top pulley wheel 14 and clamp 18. The forces on top pulley wheel 14 and clamp 18 are substantially vertical and the force exerted by the bottom pulley wheel 16 is at an angle to the vertical to transfer the lateral force exerted by the part of the mooring cable to the ship and the vertical force from the part of the mooring cable to top pulley wheel 14. FIG. 1 shows clamp 18 symbolically as a box. In the following an advantageous embodiment of clamp 18 will be described, but in principle, clamp 18 may simply be a connection of the mooring cable to foot 11.

The hydraulic cylinder assembly functions as a reversible hydraulic compression force limiter, by limiting reaction forces from the hydraulic cylinder assembly in reaction to the downward compression force exerted by pulley wheel 14. At least when the downward force exerted by pulley wheel 14 exceeds a threshold hydraulic cylinder assembly does not further resist compression, and when the downward force drops below the threshold force the hydraulic cylinder assembly pushes top pulley wheel 14 back up at least until it reaches a maximum extension.

The downward movement of top pulley wheel 14 has the effect that more mooring cable length to the ship becomes available at least once the force reaches the threshold. In the case of a mooring cable, the forces on the mooring cable the force is due to forces on the moored ship, e.g. due to wind load or swell. With increased mooring cable length to the ship, the ship is allowed to move, which has the effect that the force exerted on the mooring cable will drop off. Thus, the ship is allowed to move by the amount needed to avoid that the force on the mooring cable exceeds the threshold. Once the forces on the moored ship drop off, the upward movement of top pulley wheel 14 hauls the mooring cable back in.

Figure 2:
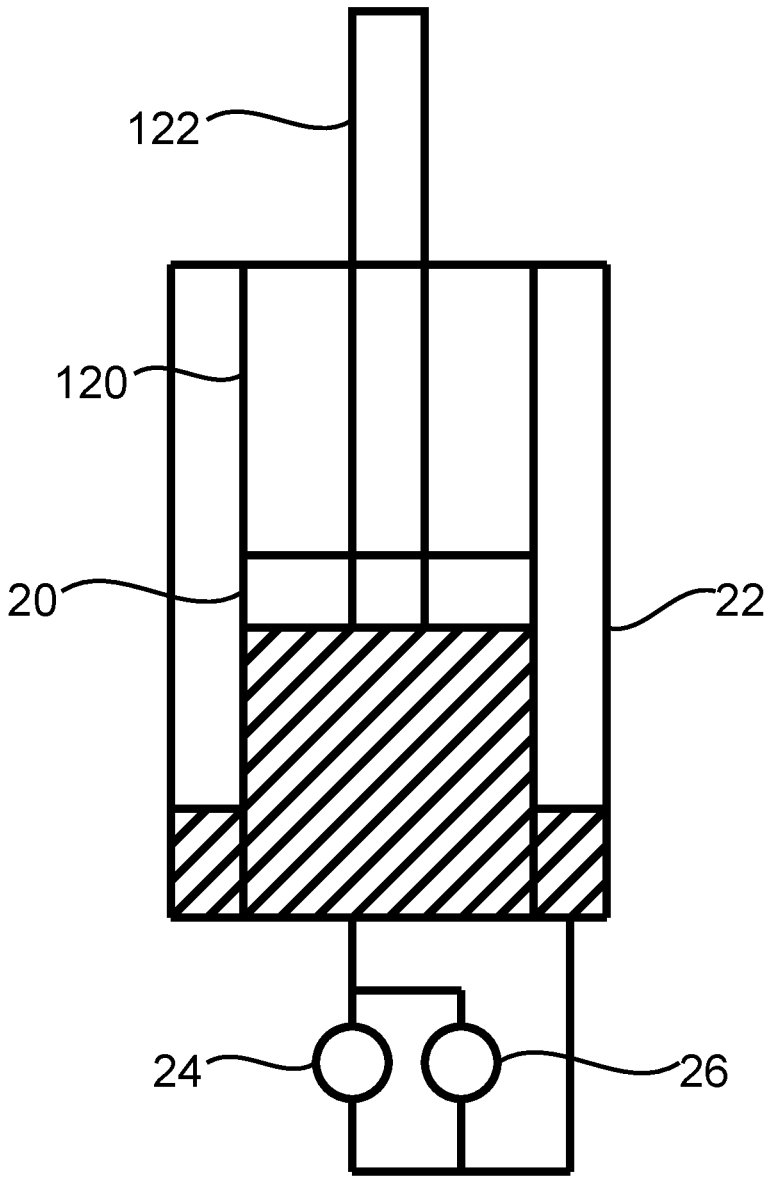
FIG. 2 shows a hydraulic circuit

FIG. 2 shows the hydraulic circuit of an embodiment of hydraulic cylinder assembly 120, 122. Piston rod 122 is located in hydraulic cylinder 120. Hydraulic cylinder 120 is filled with hydraulic liquid between a piston 20 and the bottom of hydraulic cylinder 120. Piston 20 and piston rod 122 may form an integral structure, or piston 20 and piston rod 122 may be separate structures that are joined to move as one structure. In both cases piston 20 and piston rod 122 will be indicated as referred to as Apart from hydraulic cylinder 120 and piston rod 122, the hydraulic circuit comprises a closed reservoir 22 that is at least partly filled with gas (e.g. air, or nitrogen). In an embodiment (not shown), closed reservoir 22 surrounds hydraulic cylinder 120, an inner wall of closed reservoir 22 being formed by an outer wall of hydraulic cylinder 120 and an outer wall of closed reservoir 22 being formed by a further cylindrical wall around the outer wall of hydraulic cylinder 120.

Hydraulic liquid is present in hydraulic cylinder 120 below piston 20 and at the bottom of reservoir 22. Furthermore, the hydraulic circuit comprises a first and second valve 24, 26 in hydraulic liquid conduits between reservoir 22 and the bottom of hydraulic cylinder 120, i.e. the part of hydraulic cylinder 120 toward which piston rod 122 compresses the hydraulic liquid.

First valve 24 is an over-pressure valve, configured to allow flow of the hydraulic liquid from hydraulic cylinder 120 to reservoir 22 when the hydraulic liquid pressure in hydraulic cylinder 120 exceeds the pressure in reservoir 22 by more than a first predetermined threshold difference. Second valve 26 is a one way valve, configured to allow flow of the hydraulic liquid from reservoir 22 to hydraulic cylinder 120 when the hydraulic liquid pressure in hydraulic cylinder 120 drops below the pressure in reservoir 22 (or when the difference between the hydraulic liquid pressure in hydraulic cylinder 120 and the pressure in reservoir 22 drops below a second predetermined threshold lower than the first predetermined threshold difference). As will be appreciated, the first and second valve may be implemented as a single valve that is closed only when the pressure in the hydraulic cylinder is in a range between the thresholds. The valves or the single valve may be controlled to do so based on pressure registered by a pressure sensor (not shown) for sensing pressure in 5 the hydraulic cylinder. Electronic or mechanical control may be used. The sensor and/or the mechanical control may be integrated with the valve.

Because piston rod 122 pushes piston 20 against the hydraulic fluid, the pressure on the hydraulic fluid is equal to the force exerted by piston rod 122 divided by the cross-section area of hydraulic cylinder, unaffected by the thickness of piston rod 122. When the pressure on the hydraulic liquid exceeds a threshold pressure defined by the first predetermined threshold difference, the hydraulic circuit will give way to pressure from piston 20, allowing piston rod 122 to descend into hydraulic cylinder substantially without further increase of the force on piston rod 122.

The downward force exerted on the hydraulic cylinder assembly by the top pulley wheel 14 is twice the force exerted on the mooring cable. When the pulling force that a ship exerts on the mooring cable exceeds half the threshold force, piston 20 descends in cylinder 120 without increasing the reaction force and as a result the cable holding device pays out cable. When the pulling force from the ship drops away, hydraulic liquid from reservoir 22 returns to hydraulic cylinder 120, pushing piston 20 upward, causing the mooring cable to be hauled back as the piston ascends in the cylinder.

It should be noted that instead of the illustrated embodiment of the reversible hydraulic compression force limiter other reversible force limiter arrangements may be used, for example similar to those described in WO 2018/048303. Furthermore, it should be appreciated that the hydraulic cylinder assembly may be inverted, so that hydraulic cylinder 120 is on top, piston rod 122 being connected to foot 11 and top pulley wheel 14 being located on top of the hydraulic cylinder 120. Similarly, the path of the mooring cable may be made more complicated, e.g. so that that hydraulic cylinder 120 and piston rod 122 need not be vertical, or that more than one compression force limiters can be used.

In another embodiment, a reversible tension force limiter may be used instead, for example when a pulley arrangement is used that pulls out piston rod 122 due to tension on the mooring cable rather, than pushing piston rod in. For example two additional pulley wheels on a frame may be added, so that the additional pulley wheels are above top pulley wheel 14 and the mooring cable runs up from bottom pulley wheel 16 to a first additional pulley wheel, from there down to top pulley wheel 14 and subsequently from top pulley wheel 14 up to a second additional pulley wheel and from there down to clamp 18. In that case top pulley wheel 14 will be pulled up when the mooring cable comes under tension.

An embodiment of a reversible tension force limiter is similar to the described reversible compression force limiter except that the hydraulic liquid and the connection from hydraulic cylinder 120 to reservoir 22 may be provided at the top piston rod side of piston 20 in hydraulic cylinder 120, i.e. on the other side of piston 20, with a sealing around piston rod 122 at the top of hydraulic cylinder 120. The same goes in this case if the top pulley wheel is moved to the bottom of hydraulic cylinder 120. Similarly, additional pulley wheels may be used to redirect the force on the hydraulic cylinder assembly in other directions, so that hydraulic cylinder 120 may be oriented in other directions. But the embodiment shown in FIG. 1 is the most robust solution.

Figure 3:
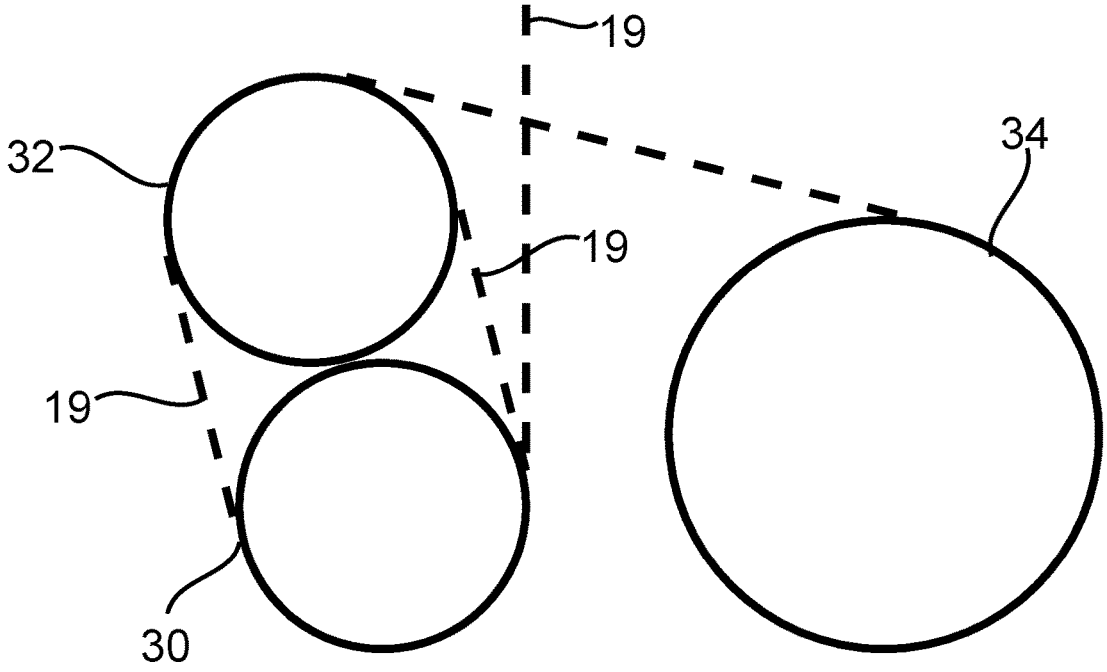
FIG. 3 shows a clamp assembly

FIG. 3 shows a clamp assembly that forms an embodiment of clamp 18 that transmits forces exerted by the cable to the force base. The clamp assembly distributes the forces on the mooring cable and makes it possible to adjust the length of the mooring cable from the mooring post to the ship. In the illustrated embodiment, the clamp assembly comprises spooling drum 34 for storing excess mooring cable length and a friction drum pair, comprising a first and second friction drum 30, 32 of equal diameter, for performing the clamping by transmitting the tension from the mooring cable to the force base. The first and second friction drum 30, 32 are referred to as friction drums because friction between their surface and the mooring cable serves to transfer forces between the drums and the mooring cable. First and second friction drum 30, 32 are coupled to the force base and kept in a fixed spatial relation relative to each other. For example, first and second friction drum 30, 32 may be mounted both between a pair of mounting plates (not shown). The mounting plates are connected to the foot of the cable holding device (not shown), that is used as the force base. Preferably, first and second friction drum 30, 32 are positioned with their rotation axes nearly horizontal and nearly vertically above one another.

The path 19 of the mooring cable runs from the top pulley wheel (not shown) to first friction drum 30 (the lowest of the friction drum pair) and from there a plurality of times back and forth between second and first friction drum 32, 30 and finally to spooling drum 34.

Figure 4A:
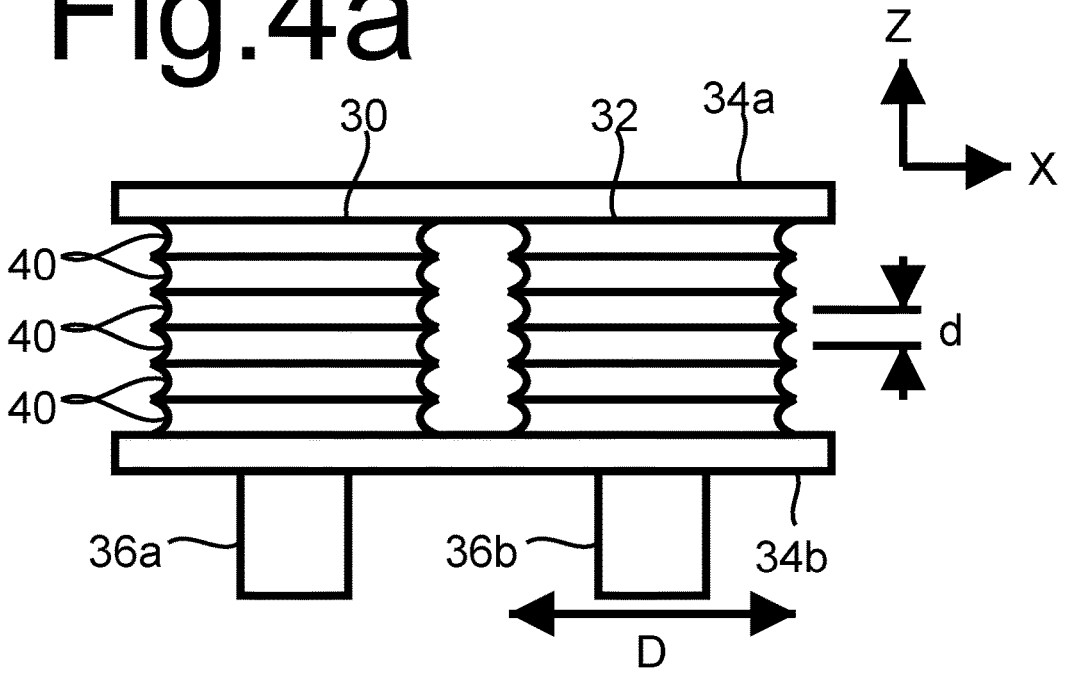
FIG. 4*a-c* show side views of a friction drum pair unit
Figure 4B:
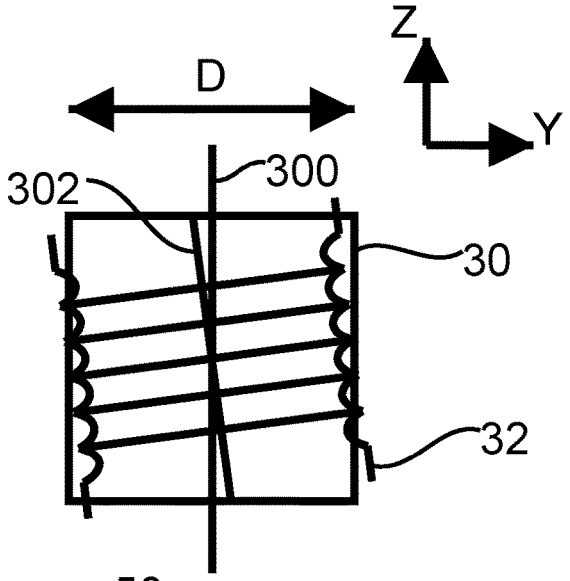
Figure 4C:
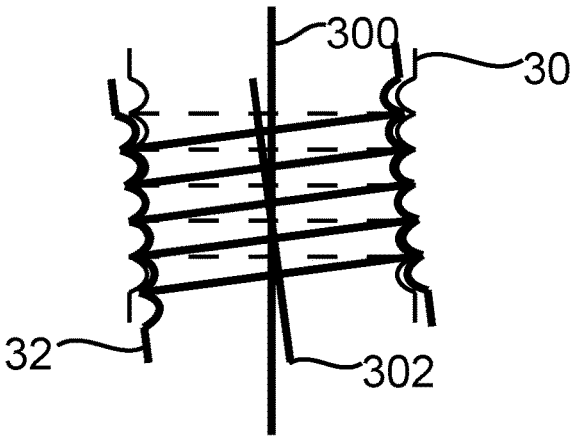

FIGS. 4*a-c* show side views of an embodiment of a friction drum pair unit. The friction drum pair unit comprises first and second rotatable friction drums 30, 32, a first and second mounting plate 34*a,b* and motors 36*a,b*. In these figures, coordinate axes are indicated, wherein the z-axis is in the direction of the rotation axis of first friction drum 30, the x axis is substantially the direction of offset between the friction drums (offset of their rotation axes), i.e. the direction of the cable part that extends from one drum to the other. The y axis is orthogonal to the x and z axes. As will be discussed, the rotation axes of the friction drums 30, 32 preferably lie in parallel y-z planes, the x axis being perpendicular to these planes.

First and second friction drum 30, 32 are rotatably mounted on one side on first mounting plate 34*a*, and at the opposite side on second mounting plate 34*b*. The surface of each of first and second friction drum 30, 32 comprises a plurality of circular grooves 40, i.e. not a helical groove, but separate grooves, each groove parallel to a plane perpendicular to the rotation axis of the drum, the groove returning into itself after running along a full circle. Six grooves have been found to be sufficient for practical purposes. However, it should be noted that another number of grooves may be used, e.g. use of more grooves works, and less grooves may suffice for certain classes of ships. Also, it may suffice to use grooves for individual turns of the mooring cable only on one of the friction drums.

FIGS. 4*b,c* show first and second friction drum 30, 32 in cross sections in z-y plane, i.e. in planes perpendicular to the offset between the friction drums 30, 32, together with the rotation axes 300, 302 of the first and second friction drum 30, 32 respectively. In FIG. 4*b* the grooves on first friction drum 30 are not shown, for the sake of clarity, whereas first friction drum 30 is shown dashed in FIG. 4*c*. As shown in FIG. 4*b,c*, the rotation axes 300, 302 of first and second friction drum 30, 32 are not parallel, but at a non-zero angle, slightly rotated relative to each other around the x axis, i.e. the direction of the offset between the friction drums. The rotation axes of both friction drums may be non-perpendicular to the mounting plates, or the rotation axis of one friction drum may be—perpendicular to the mounting plates and that of the other non-perpendicular. Preferably, the rotation axes 300, 302 lie in parallel planes (y-z planes). The angle is set so that the entry point and the exit point of the cable path along a semi-circle in a groove around second friction drum 32 are displaced in the axial (z-) direction of the first friction drum 30 over the distance between successive grooves 40 on the first friction drum 30. In one example, the angle is eight degrees.

In mathematical terms, when the friction drums 30, 32 have the same outer diameter "D" and the pitch (groove heart to groove heart distance) between successive grooves is "d" (cf. FIG. 4*a*) on both friction drums, the sine of the angle between the central rotation axes of the friction drums is d/D (i.e. sin(angle)=d/D). Thus, a given pitch defines the optimal angle between the rotation axes or vice versa the angle defines the optimal pitch "d". It should be emphasized that the actual angle need not be exactly equal to this mathematical relation: approximate equality suffices (e.g. that sin(angle) is between (d−w)/D and (d+w)/D where w is an error margin that is less than half the pitch d, e.g. a quarter of the pitch). Furthermore, it may be noted that it is not strictly necessary that the friction drums have the same diameter: if first and second friction drum 30 have a diameter D1, D2, respectively, the sine of the angle may be d1/D2 (sin(angle)=d1/D2) or at least between (d1−w)/D2 and (d1+w)/D2 and d1/D2=d2/D1.

Figure 5:
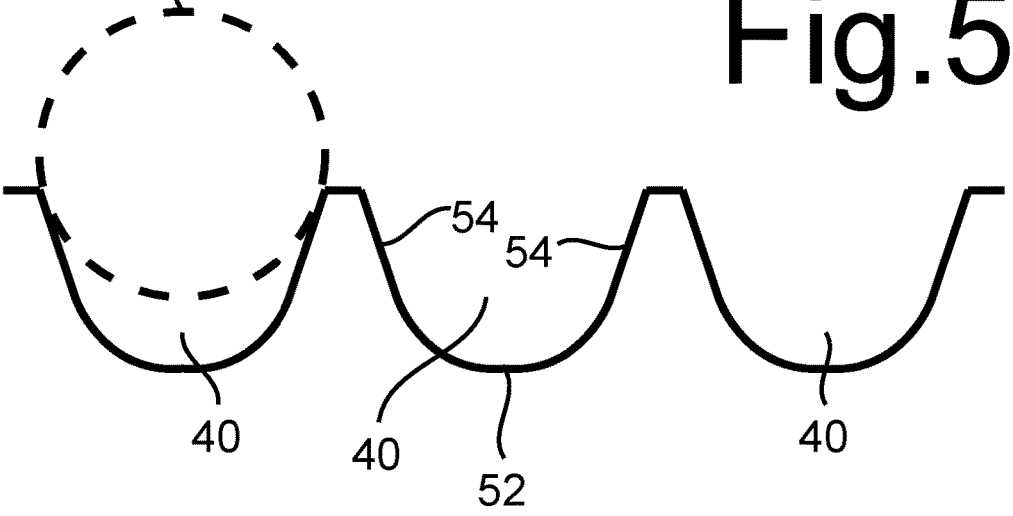
FIG. 5 shows grooves of friction drums

FIG. 5 shows an embodiment of the grooves 40 of the friction drums in more detail. Preferably, the surface of first and second friction drum 30, 32 in grooves 40 is a roughened surface. In one example the surface in the grooves may be roughened by stainless steel powder blasting. In cross-section, the wall of grooves 40 has a U-shape at the bottom of groove 40 and a V-shape cross-section higher up. In the U-shaped part groove 40 has a circle segment cross-section part 52 of at least a 60 degree circle segment. The V shape part 54 of the cross-section diverge, without curvature, or at least with a variable or constant radius of curvature that is larger than in the circle segment cross-section part 52.

The groove width of drum pair unit may be designed to be adapted to a given mooring cable type. In the circle segment cross-section part 52, grooves 40 have a radius of curvature that is smaller than the radius of the mooring cable 50 when the latter is not under tension, but so large that increasingly more of the mooring cable fits into the circle segment cross-section part 52 of the groove when the mooring cable diameter decreases due to increasing tension on the mooring cable. The width may depend on the diameter and type of mooring cable.

In one example, the width may be designed for a mooring cable of dyneema (polyethylene) with a diameter of 77 millimeter absent tension. Under tension, the diameter of such a mooring cable may decrease to about 70-71 millimeter. Friction drums 30, 32 have a much larger diameter, e.g. 500 millimeter or more, so that mooring cable fatigue due to bending is limited.

In operation, the mooring cable may be wound on the drum pair unit 30, 32 before use to moor ships. For example, the mooring cable may first be wound on spooling drum 34 and the end of the cable from spooling drum 34 may be wound back and forth over friction drums 30, 32 a number of times. The mooring cable may be pulled out from the drum pair unit while motors 36*a,b* synchronously rotate first and second friction drum 30, 32.

When a ship is moored, the end of the mooring cable is brought to the ship and fixed to the ship, or connected to a cable from the ship. Subsequently, first and second friction drum 30, 32 are rotated synchronously around their axes, in a direction so that the mooring cable winds onto the lower drum and from there, after a half a revolution onto the upper drum and so on. In this way the mooring cable is hauled in from the ship. For example the mooring cable may be hauled in until is becomes taut between the mooring post and the ship, without causing the over-pressure valve in the hydraulic circuit to open. Preferably, the mooring cable is hauled in so far that an excessive movement of the cable connection point on the ship will cause the over-pressure valve in the hydraulic circuit to open.

Motors 36*a,b* are coupled to drive the rotation of first and second friction drum 30, 32, e.g. via a slip-coupling. Motors 36*a,b* may comprise a planetary gearwheel assembly to increase the torque. Each motor 36*a,b* may further be coupled to a stationary arm (not shown) to provide a reaction force that keeps the stationary part of the motor from rotating. The arm may be coupled e.g. to an arm of the other motor and/or to mounting plate 34*a* and/or both. Synchronous rotation may be ensured by using slip-couplings between motors 36*a,b* and first and second friction drum 30, 32.

The slip coupling has the further advantage that it can be used to limit the downward force exerted on the hydraulic cylinder assembly once the hydraulic cylinder assembly has been maximally compressed.

Alternatively, the motor or motors 36*a,b* may be used in a controlled slip mode, wherein the motor or motors 36*a,b*, e.g. under control of a control circuit, cause first and second friction drum 30, 32 to rotate synchronously to pay out the mooring cable while a stress of the mooring cable exceeds a threshold.

The slip coupling or controlled slip mode defines a slip threshold force exerted by the mooring cable, at which the force exerted by the mooring cable causes the slip coupling to start slipping, or the controlled slip mode is activated. Similarly, the hydraulic cylinder assembly defines a compression threshold force exerted by the mooring cable at which the force exerted by the mooring cable causes the hydraulic cylinder assembly to start compression.

In an embodiment the slip threshold force as exerted by the mooring cable is larger than the compression threshold force as exerted by the mooring cable. (As used herein the slip threshold force and the compression threshold force relate to the stress levels in the mooring cable at which the coupling slips and the hydraulic cylinder assembly starts to compress).

As a result, when the stress on the mooring cable increases and reaches the compression threshold force, the hydraulic cylinder assembly will first pay out the mooring cable. If the hydraulic cylinder assembly is maximally compressed and the stress on the mooring cable increases further, reaching the slip threshold force, the slip coupling or friction drums 30, 32 slip operating in controlled slip mode will pay out the mooring cable. Although the same slip coupling may be used for both coupling to the motor(s) that drive(s) friction drum and for allowing pay-out, it should be appreciated that distinct slip coupling may be used for these purposes instead.

In an embodiment, the control circuit is configured to determine when the hydraulic cylinder assembly is maximally compressed using one or more position sensors that sense the position of the piston relative to the cylinder instead of, or in addition to a hydraulic pressure sensor.

In an embodiment, the control circuit is configured to cause motor or motors 36*a,b* to make the friction drums start paying out the mooring cable in response to detection that the hydraulic force limiter has given way over a predetermined distance, so that a predetermined length of mooring cable has been paid out. For example, the control circuit may do so in response to detection that the piston has reached its stop that limits its movement under compression, In another embodiment the control circuit may do so in response to detection that the measured piston position indicates that the compression distance of the hydraulic cylinder assembly exceeds a first threshold compression.

In these embodiments, the control circuit is configured to cause paying out of the mooring cable to continue in the controlled slip mode until the position sensor indicates that the hydraulic cylinder assembly has expanded by more than a threshold distance from the stop position or from the first threshold compression, and to stop paying out the mooring cable once this threshold distance is reached. This places the hydraulic cylinder assembly in a position to respond to movement of the moored ship.

Paying out the mooring cable with the friction drum provides for paying out a greater range of mooring cable length than with the hydraulic cylinder assembly, but usually at a more limited maximum speed. Another difference between paying out the mooring cable with the hydraulic cylinder assembly and paying out the mooring cable with the friction drums using the slip coupling or controlled slip coupling is that the former is inherently reversed when the stress on the mooring cable drops and the latter is not.

Preferably, when a length of mooring cable has been paid out due to slipping of the slip coupling or operation in the controlled slip mode, the motor or motors 36*a,b* that drive the rotation of first and second friction drum 30, 32 are activated after the force due to the stress on the mooring cable has dropped below the compression threshold force. The spooling drum may be operated simultaneously with friction drum 30, 32 to receive the length of hauled in mooring cable.

For example, friction drums 30, 32 may be operated to haul in the same length of mooring cable as has been paid out earlier when the force reached the slip threshold force, or hauling may be continued until the force exerted by the mooring cable reaches a predetermined threshold below the compression threshold force. The mooring post unit may comprise a sensor or sensors to help select the length of hauling, e.g. a rotation sensor configured to sense an amount of rotation of friction drums 30, 32 during pay-out and hauling, or a pressure sensor configured to measure the pressure of the hydraulic fluid in the cylinder of the hydraulic cylinder assembly. A camera may be used to obtain images of the mooring cable or the moored ship in relation to the mooring.

The operation to haul in may be controlled remotely by an operator (ashore or on the ship) using input from the sensor or sensors, and/or based on images. Alternatively, automated hauling control may be used, under control of the control circuit, with inputs coupled to such a sensor or sensors and an output for controlling rotation of friction drums 30, 32.

In an embodiment motors 36*a,b* are hydraulically driven motors or electric motors, driven through a common supply conduit with hydraulic fluid. Thus the rotation is synchronized in the sense that the forces are dynamically balanced. If one friction drum temporarily offers a smaller resistance force than the other, the hydraulic pressure will make the friction drum that offers less resistance rotate slightly more than the other, with the effect that the resistance difference is reversed. The mooring post may have an electric pump to create pressure in the hydraulic circuit of the motors. In another embodiment a gear wheel coupling between the motors may be used to synchronize the motors. When electric motors are used, the motors may alternatively be synchronized electronically.

Although a motor assembly comprising two motors is shown, it should be appreciated that instead a motor assembly comprising a single motor on one of friction drums 30, 32 and a mechanical transmission from that drum to the other or mechanical transmissions from the single motor and both drums may be used. In one embodiment, synchronous rotation may be ensured by using slip-couplings between the single motor and first and second friction drum 30, 32, the slip-couplings being arranged to ensure that the motor force is transmitted to the friction drum 30, 32 that offers the least resistance force, or to both if they offer the same resistance force.

When the first and second friction chum 30, 32 are rotated, the cable part that emerges from the drum pair unit may be wound onto spooling drum 34, which may be driven by a further motor (not shown), that requires less power than motors 36*a,b*. Similarly, spooling drum 34 may pay out cable when first and second friction drum 30, 32 are operated with both friction drums in reverse.

After hauling in the mooring cable during mooring, rotation of first and second friction drum 30, 32 is locked relative to the mounting plates. This brings the cable holding device in a fail safe state, wherein no power supply, such as for motors 36*a,b* is needed for its operation. When the mooring cable comes under stress, the mooring cable exerts racial forces on the semi-circles on first and second friction drum 30, 32 wherein the mooring cable curves around first and second friction drum 30, 32. These radial forces cause a circumferential stick slip force along the mooring cable in the grooves which gradually transfers the pulling force on the mooring cable to first and second friction drum 30, 32. After each semi-circle the stress on the mooring cable becomes smaller.

Furthermore, with increasing pulling force on the mooring cable, the mooring cable diameter decreases. As a result the mooring cable enters deeper into grooves 40, so that its contact area with first and second friction drum 30, 32 increases, thereby increasing the stick slip force that transfers the pulling force to first and second friction drum 30, 32.

As will be appreciated, the use of first and second friction drum 30, 32 to clamp the mooring cable reduce the maximum force on the mooring cable compared to a solution wherein the mooring cable is clamped by fixing it at one point. At the same time it allows for motor driven adjustment of the length of mooring cable to the ship.

Furthermore, the use of first and second friction drum 30, 32 makes it possible to pay out or haul in mooring cable even when the mooring cable is under stress. Basically this involves synchronous rotation of first and second friction drum 30, 32 as described for mooring. The mooring cable can be hauled in by synchronously rotating first and second friction drum 30, 32 in the same direction as during mooring. The mooring cable can be paid out by synchronously rotating first and second friction drum 30, 32 opposite to that direction.

In both cases, the use of two drums has the advantage that the mooring cable does not need to slip under stress over the drums in the axial direction of the drums or through the grooves, in contrast to when a helical groove would be used. Instead, axial displacement of each part of the mooring cable relative to each drum is realized by moving that part of the mooring cable to the other drum, and rotating the part with the other drum around a rotation axis at a slightly different angle. This reduces wear of the mooring cable.

As will be appreciated, the same advantage can be realized by using more than two (N>2) friction drums, at least some of which have rotation axes at slight angles to each other. Herein the angles may be selected so that the exit point of the cable path from the groove around each friction drum is at the same distance from the common base of the drums as the entry point of the cable path to the groove around the next friction drum. Thus, the mooring cable may run successively over the N friction drums and then back to the first of the successive friction drums.

Although an embodiment has been described wherein the friction drums have the same diameter, it should be noted that this is not strictly needed. It suffices that the exit point of the cable path from the groove around each friction drum is at the same distance from the common base of the drums as the entry point of the cable path to the groove around the next friction drum and that the sum of the changes of the distance between the cable path and the common base of all friction drums approximately corresponds to the pitch of the grooves.

Using more than one friction drum in combination makes it possible to use circular grooves, so that the circular grooves can be used to increase the (stick) slip force with a minimal effect on mooring cable wear. However, dependent on the size of the force that is needed, and number of times the cable runs around the drums, the drums may have shallower grooves than the illustrated embodiment, or successive cable parts may even lie next to each other wound around the plurality of friction drums without using grooves in the friction drums for separate windings.

The ability to use first and second friction drum 30, 32 or more friction drums to pay out or haul in mooring cable under stress makes it possible to use friction drum 30, 32 or more friction drums to pay out the mooring cable when it is detected that the hydraulic force limiter limits the force not merely due to passing force peaks on the ship. Similarly, it possible to use friction drum 30, 32 to haul in the mooring cable when it is detected that the force exerted by the mooring cable remains below a threshold longer than a predetermined time.

In an embodiment, the hydraulic force limiter may be provided with sensors to detect such conditions, e.g. in the form of one or more position sensors for detecting an indication of the position of the piston, or whether the piston has passed an upper or lower threshold position. In other embodiments, a hydraulic pressures sensor or sensors configured to sense pressure in the cylinder, and/or a level sensor configured to sense the hydraulic fluid level in the reservoir. Sensor results may be transmitted to a control room, from which the motors may be activated to rotate the friction drums. The mooring post may comprise a communication system configured to transmit sensor results and receive motor control commands for this purpose. The communication system may be a wireless system for example, which uses a wireless data network receiver or transmitter or a wired system, i.e. using a communication cable that runs to the mooring post below the sea floor.

In an embodiment, an automatic adjustment system may be used, e.g. with a control computer or other control circuit, which is configured to activate the motors when the sensor of sensors indicate that the force on the mooring cable lies above an upper threshold or below a lower threshold, or that this is so for more than a predetermined amount of time.

When the ship has been unmoored, the mooring cable is decoupled from the ship. When that has happened, motors 36*a,b* may be started to synchronously rotate first and second friction drum 30, 32 so as to haul the mooring cable from the ship and the cable mooring cable is wound onto spooling drum 34. post It may be noted that the described type of clamp may also be used for clamping mooring cables from ships at other locations than on mooring posts, e.g. along a quayside. The rotation axes of the friction drums do not need to be horizontal. Instead, they may be vertical for example. The clamp may be used as a dynamic bollard, which enables remote control of the length of cable from the bollard to a ship, even under loaded conditions when the mooring cable remains under the stresses that occur when a ship remains moored.

The invention claimed is:

1. A mooring post unit comprising a mooring post and a cable holding device on top of the mooring post, the cable holding device comprising:

a first pulley wheel, a second pulley wheel and a cable clamp, arranged to guide a mooring cable from a ship over the first pulley wheel to the clamp, back and forth via the second pulley wheel, a hydraulic force limiter coupled between the second pulley wheel and the mooring post, with a rotation axis of the second pulley wheel mounted on the hydraulic force limiter transverse to a direction wherein the hydraulic force is expandable and compressible, the hydraulic force limiter being configured to start limiting a reaction force from the hydraulic force limiter in response to force exerted by the second pulley wheel as a result of a pulling force on the mooring cable during expansion or compression of the hydraulic force limiter when the pulling force exceeds a predetermined threshold, wherein the cable clamp comprises a cable clamping device, the cable clamping device comprising, a first rotatable friction drum, having a first axis of rotation;

a second rotatable friction drum, offset from the first rotatable friction drum in an offset direction transverse to said axis of rotation, the second of rotatable friction drum having a second axis of rotation, the first and second axis of rotation having a rotation relative to each other around said offset direction;

the first and second friction drum defining a mooring cable path that runs back and forth between the first and second friction drum alternately in successive semicircles around the first and second rotatable friction drum;

wherein an angle of the relative rotation of the first and second rotation axis is so that intersections of the mooring cable path with a virtual plan perpendicular to said offset direction, on opposite sides of the second rotatable friction drum, are at least approximately offset in the direction of the first axis of rotation by a pitch of the mooring cable path;

a motor or motors arranged to drive rotation of the first and second rotatable friction drum, synchronously around the first and second rotation axis respectively.

2. The mooring post unit according to claim 1, configured to allow or make the first and second rotatable friction drum to rotate to pay out the mooring cable when a stress in the mooring cable reaches a slip threshold, which exceeds a compression threshold at which the stress in the mooring cable causes the hydraulic force limiter to start limiting the reaction force and/or when the hydraulic force limiter has moved to give way at least over a predetermined length.

3. The mooring post unit according to claim 1, wherein at least the second friction drum has a plurality of circular grooves around the rotation axis of the second friction drum, the circular grooves defining successive parts of the mooring cable path on the second friction drum, wherein an angle of the relative rotation of the first and second rotation axis is so that cross sections of each groove, with a virtual plane perpendicular to said offset direction, on opposite sides of the second rotatable friction drum, are at least approximately offset in the direction of the first axis of rotation by a pitch of the mooring cable path on the first rotatable friction drum.

4. The mooring post unit according to claim 1, wherein the first friction drum has a plurality of further circular grooves around the rotation axis of the first friction drum, the further circular grooves defining successive parts of the mooring cable path on the first friction drum.

5. The mooring post unit according to claim 1, comprising a motor driven spooling drum on the mooring post, arranged to receive and feed the mooring cable from and to the first friction drum.

6. The mooring post unit according to claim 1, comprising a mooring cable, the mooring cable running through successive ones of the grooves back and forth to the first friction drum.

7. The mooring post unit according to claim 6, wherein the grooves have a cross-section at least partly in the shape of a circle segment, with a circle radius that is smaller than a radius of the cross-section of the mooring cable when the mooring cable is free of stress, and at least as large as a radius of the cross-section of the mooring cable when the mooring cable is under a stress.

8. The mooring post unite according to claim 1, wherein the grooves have a roughened surface.

9. The mooring post unite according to claim 1, comprising a control circuit configured to activate the motor or motors to rotate the first and second friction drum synchronously in a selectable direction in response to reception of a command signal that indicates the direction.

10. The mooring post unit according to claim 1, wherein the mooring cable is made of dyneema.

11. The mooring post unit according to claim 1, comprising a rotatable foot, arranged to rotate around the vertical direction of the mooring post, the first pulley wheel, the second pulley wheel, the cable clamp and the hydraulic force limiter being mounted on said foot.

12. The mooring post unit according to claim 1, wherein the hydraulic force limiter is a hydraulic compression force limiter having a proximate and distal end, proximate and distal relative to the mooring post respectively, the second pulley wheel being mounted at the distal end, the first pulley wheel and the cable clamp being mounted next to the proximate end.

13. The mooring post unit according to claim 1, wherein said direction of expansion and compression of the hydraulic force limiter is in the vertical direction of the mooring post.

14. The mooring post unit according to claim 1, wherein the a hydraulic force limiter comprises a hydraulic cylinder, a piston in the hydraulic cylinder, a piston rod coupled to the piston or forming an integral part with the piston, an expansion reservoir and a first and second one way valve coupled to pass hydraulic fluid to and from the expansion reservoir from and to the hydraulic cylinder respectively, the first one way valve having a higher opening pressure than the second one way valve.

* * * * *